United States Patent [19]

Boretti

[11] 4,316,523

[45] Feb. 23, 1982

[54] SILENCER FOR GAS DISCHARGE DEVICES

[76] Inventor: Napoleon P. Boretti, 13834 Del Webb Blvd., Sun City, Ariz. 85351

[21] Appl. No.: 156,479

[22] Filed: Jun. 4, 1980

[51] Int. Cl.[3] ..... F01N 1/10; F01N 1/24; F01N 7/18

[52] U.S. Cl. ..... 181/226; 181/230; 181/241; 181/243; 181/258

[58] Field of Search ..... 181/226, 230, 238–239, 181/243, 248, 252, 256–258, 279, 241; 55/276

[56] References Cited

U.S. PATENT DOCUMENTS

| | | | |
|---|---|---|---|
| 763,626 | 6/1904 | Ogden | 181/264 |
| 797,681 | 8/1905 | Gray | 181/236 |
| 1,479,714 | 1/1924 | Herdle | 181/263 |
| 1,512,210 | 10/1924 | Gaskins | 181/254 |
| 1,666,005 | 4/1928 | Culp | 181/265 |
| 3,208,551 | 9/1965 | Carls | 181/226 |
| 3,219,144 | 11/1965 | Murray et al. | 181/278 |
| 3,380,553 | 4/1968 | Gibel | 181/230 |
| 3,612,214 | 10/1971 | Blatt | 181/257 |
| 3,672,465 | 6/1972 | Blatt et al. | 181/258 |
| 3,823,743 | 7/1974 | King | 181/258 X |
| 4,134,472 | 1/1979 | Trainor | 181/258 |

FOREIGN PATENT DOCUMENTS

| | | | |
|---|---|---|---|
| 2653262 | 6/1978 | Fed. Rep. of Germany | 181/258 |
| 403939 | 10/1909 | France | 181/239 |
| 495576 | 11/1938 | United Kingdom | 181/256 |

*Primary Examiner*—L. T. Hix
*Assistant Examiner*—Thomas H. Tarcza
*Attorney, Agent, or Firm*—Warren F. B. Lindsley

[57] ABSTRACT

Silencers for gas discharge devices employing easily replaceable cartridges utilizing juxtapositioned layers of wire mesh and porous absorbed material which dissipate exhaust noises of an exhaust system and deflect under pressure of the exhaust gases to provide a self cleaning function.

23 Claims, 11 Drawing Figures

SILENCER FOR GAS DISCHARGE DEVICES

BACKGROUND OF THE INVENTION

This invention relates to devices for muffling and silencing of noises in fluid pressure exhausts and more particularly to silencers or mufflers for the exhaust systems of compressed air operated power cylinders, tools or the like.

1. Field of the Invention

This invention is particularly directed to improved and novel muffling devices for silencing exhaust noises by directing exhaust gases under pressure through new and improved energy absorbing cartridges to atmosphere with axial and radial flow occurring in different embodiments of the muffling devices.

2. Description of the Prior Art

Heretofore, mufflers have been used for the dissipation of exhaust noises wherein the exhaust stream of gases is diverted by fins or ribs of a spider means within the mufflers. Other mufflers have dissipated exhaust noises of an exhaust system in a silencing chamber by the utilization of prorous walls through which the exhaust fluid is diffused.

U.S. Pat. No. 763,626 discloses a muffler for moving a gas to atmosphere from an engine which employes a spring biased valve movably guided on a shaft.

U.S. Pat. No. 797,681 discloses a muffler device employing a relief means for providing an alternate route for the exhaust gas in response to an increase in the pressure of the gas within the muffler.

U.S. Pat. No. 1,479,714 discloses a muffler for exhaust gases from an internal combustion engine employing an alternate route when the gas pressure reaches a given value. The alternate route is controlled by a weighted door hingedly secured to the end of the alternate route.

U.S. Pat. No. 1,512,210 discloses a muffler for an internal combustion engine employing an alternate route which opens up in response to increased pressure within the muffler which alternate route is controlled by a lever arm and spring mechanism.

U.S. Pat. No. 1,666,005 discloses a muffler employing a spring loaded valve for controlling the escape of gases under pressure.

U.S. Pat. No. 3,208,551 discloses an air silencer for pneumatic devices which includes a cylindrically shaped shell having circumferential slots therein to provide air outlets in communication with the interior of the shell and an air restricting cartridge maade of a screen material for muffling the sound of the moving air.

U.S. Pat. No. 3,219,144 discloses a muffler for an internal combustion engine which includes spring biased means for controlling an adjustable exhaust port in response to the pressure of the exhuast gas.

U.S. Pat. No. 3,380,553 discloses an exhuast muffler wherein the noise level of the fluid under pressure moving therethrough is reduced by reducing the velocity of the fluid and causing the fluid to expand thereby expending energy.

U.S. Pat. No. 3,612,214 discloses a safety relief for an air silencer for a pneumatic device which includes means for redirecting the flow of air if the pressure within the silencer reaches a predetermined level.

U.S. Pat. No. 3,672,465 discloses an air exhuast silencer employing baffle members made of a porous material wherein the air is broken up and exhausted therethrough to atmosphere.

SUMMARY OF THE INVENTION

In accordance with the invention claimed an air silencer or sound absorbing device is provided which employs an easily replaceable and adjustable novel air restricting device which effectively reduces high noise levels of escaping air from a pneumatic valve, motor and other air operated tools to a safe decibel level.

It is, therefore, one object of this invention to provide an improved fluid muffler or silencer for effectively reducing high noise levels of an escaping fluid under pressure.

Another object of this invention is to provide an improved compact, small, simple and economical muffler or silencing device that can be easily assembled and disassembled for cleaning purposes without removing the device from the exhaust system of the associated equipment.

A further object of this invention is to provide a novel and improved muffler for silencing exhaust fluid under pressure discharged from a machine which employs an easily changeable baffle arrangement formed in disc or cylindrical form.

The present invention resides in certain constructions. combinations and arrangements of the parts and further objects and advantages will be apparent to those skilled in the art to which the invention relates from the following description of the preferred embodiment described with reference to the accompanying drawings forming a part of this specification.

BRIEF DESCRIPTION OF THE DRAWINGS

The present invention may be readily described by reference to the accompanying drawing, in which.

DESCRIPTION OF THE PREFERRED EMBODIMENT

Figures 1, 2, 4, 11:
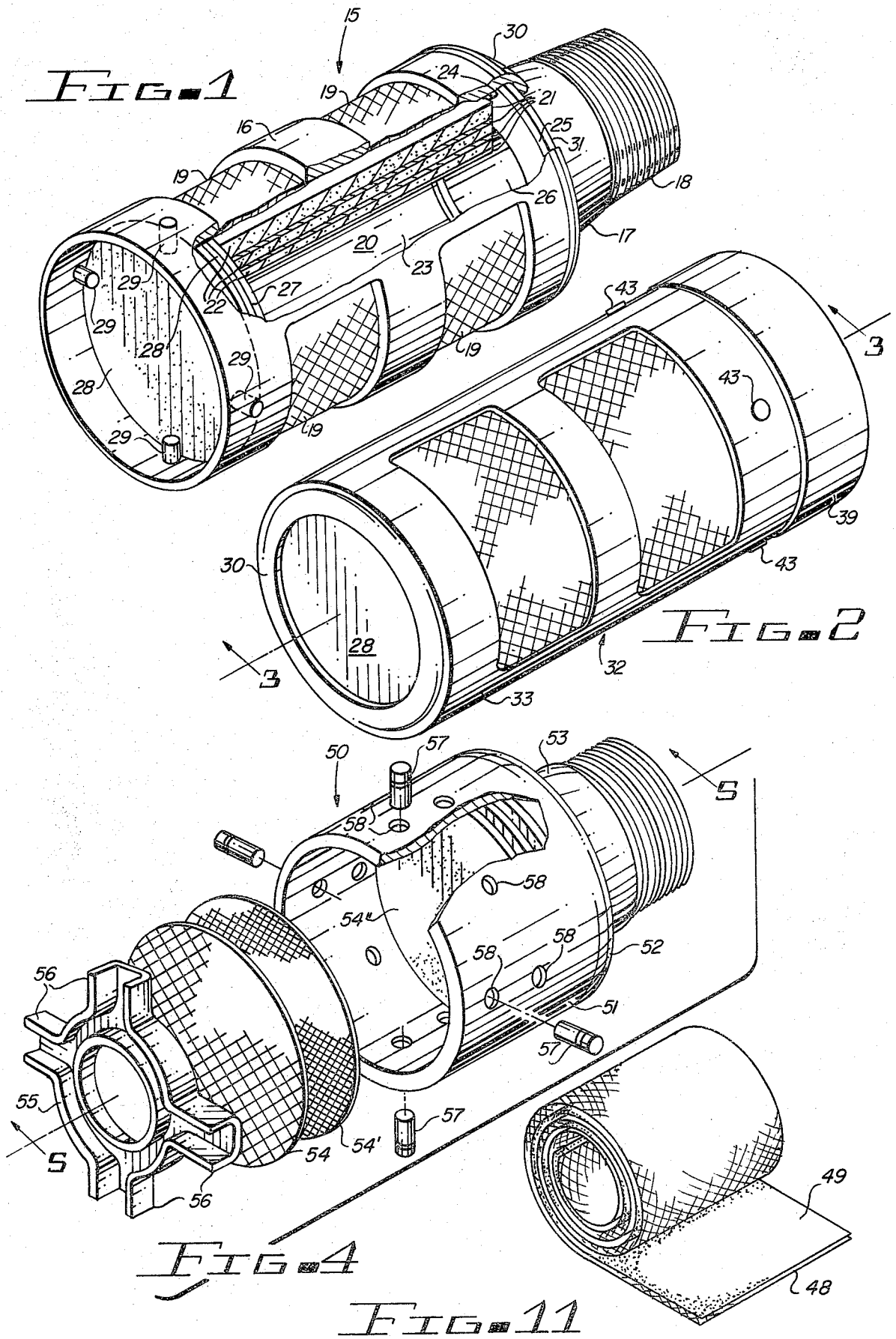
FIG. 1 is a perspective view partially broken away of a muffler or silencer embodying the invention.
FIG. 2 is a perspective view of a modification of the structure shown in FIG. 1.
FIG. 4 is an exploded perspective view of a further modification of the muffler or silencer shown in FIGS. 1 and 2.
FIG. 11 is a perspective view of the baffle cartridge shown in FIG. 10 illustrating its rolled condition.

Referring more particularly to the drawings by characters of reference, FIG. 1 discloses a silencer or muffler 15 comprising a cylindrical housing 16 connectable at one end to a coupling 17 forming the entrance port to the muffler. The coupling 17, which is thicker and heavier in construction than the walls of housing 16 to suppress vibration, may be externally threaded, as shown at 18, for connection to the exhaust of a fluid driven machine tool (not shown). The housing 16 is provided with one or more windows or exhaust ports 19 through which fluid such as air under pressure entering into the interior of the housing through coupling 17 is exhausted to atmosphere.

Within housing 16 is detachably mounted a cylindrical cartridge 20 forming a baffle for silencing the noise of the air under pressure being dispersed therethrough. This cartridge comprises a plurality of coaxially arranged cylindrical elements forming alternate layers of wire cloth material 21 and a suitable grade of compressible foam or textile material 22. These coaxially arranged cylindrical elements form a hollow cylindrical passageway 23 extending axially therethrough.

Figure 3:
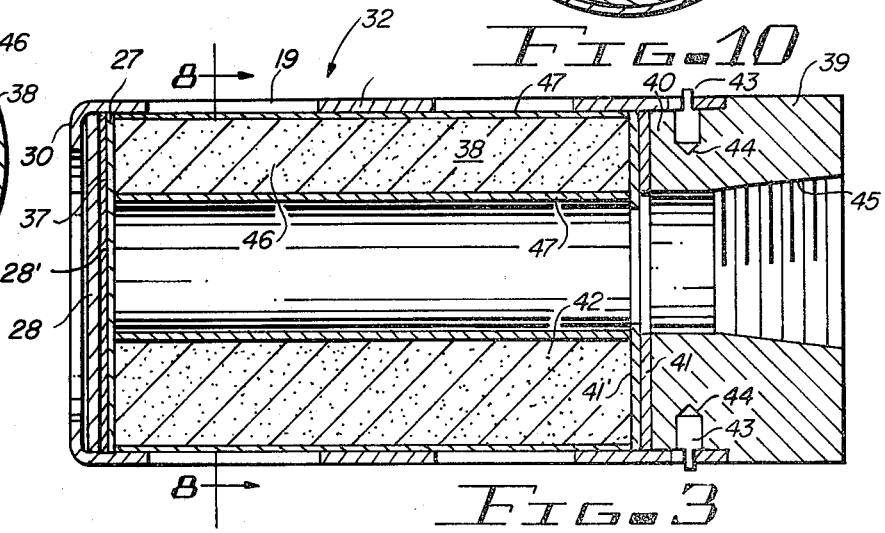
FIG. 3 is a cross-sectional view of FIG. 2 taken along the line 3—3.

Spaced between the end 24 of cartridge 20 and coupling 17 are one or more metal washers 25 having an aperture 26 extending axially therethrough which control the rate of discharge into the muffler and protects the end 24 of cartridge 20 from air erosion. As shown in FIG. 1, the soft washer 25 is utilized to dampen vibration adjacent the coupling 17. In FIG. 3, as later described, a soft washer 41 is utilized for the same purpose as well as a relatively hard washer 41' which incorporates an air flow control orifice. The coupling and washer arrangement form the inner chamber of the silencer.

As shown in FIG. 1, as well as FIGS. 2 and 3, hereinafter described, the mufflers are provided with heavy walled couplers for connection to the associated equipment which help attenuate noise amplification caused by the air discharging function of the associated equipment. The inner chamber in the cartridge provides a choking action of the explosive force of the discharged air from the associated equipment. The hard metal washer 25 at the entranceway into the hollow interior of the cartridge not only controls the rate of discharge into its hollow interior but also protects the cartridge from air erosion. The purpose of the soft metal washer is to dampen vibrations and noise generation.

As shown in FIG. 1, the left end of the housing 16 is enclosed by a resilient gasket 27 engaging the left end of cartridge 20. A soft metal plate 28' is located between gasket 27 and plate 28 to dampen noise amplification. This configuration forms a snug arrangement of the cartridge 20 within housing 16 with the right end 30 of the housing flanged to fit partially around the outwardly extending ridge 31 on coupling 17. Thus, by merely pulling out pins 29, the cartridge 20 can be removed, cleaned and/or replaced without disconnecting the muffler from the associated machine tool.

Where used, the rubber gaskets absorb the initial high velocity wave front of the discharged air which would otherwise impinge on the end metal washers and also compensate for dimensional tolerances in the assembly of the parts. In this manner, the component parts of the mufflers can be made to wider tolerances than normal to cut down on the manufacturing costs without affecting the silencer's performance. The rubber gaskets are also used to seal the gap between the shell or housing and the washers to prevent air from escaping axially past the metal plates.

In operation, air under pressure discharged from the machine tool enters the hollow interior of the coupling 17 called the inner chamber and passes therethrough into the cylindrical passageway 23 formed by cartridge 20 and called the outer chamber. The air in the outer chamber which is dispersed along the length of passageway 23 flows radially outwardly through the cylindrical elements forming cartridge 20 exiting to atmosphere through the windows or ports 19 formed in housing 16. The housing 16 forms a shell protector for the energy absorbing cartridge and acts as a retainer for the end plate assembly as well as provides by its window locations directional flow of the air discharged to atmosphere.

FIGS. 2, 3, 8, 9 and 10 disclose a muffler configuration 32 wherein like parts are given the same reference characters with its cylindrical housing 33, which is housing 16 turned end for end, closed at one end by plate 28, soft metal plate 28' and gasket 27 held in place by the turned in end 30 of housing 16 and the end 37 of a hollow cartridge 38 bearing against it. Cartridge 38 is held against gasket 27, as shown in FIG. 3, by a coupling 39 fitted into the open end 40 of housing 16 and held in bearing arrangement against one or more washers 41, 41' and the end 42 of cartridge 38 by a plurality of pins 43 spacedly arranged around the periphery of housing 16 to extend through the walls of the housing into suitable apertures 44 in coupling 39. These pins may be grooved, tapered or necked down at their outer ends so as to interlock under tension with the walls of housing 16 to be firmly held in place. To readily dislodge the pins to remove the cartridge from the housing, the housing and coupling are moved toward each other which is made possible by compressing gasket 27 thereby releasing the tension of the housing on the pins so that they can be easily removed in a known manner. This gasket may be of low durometer.

Figure 9:
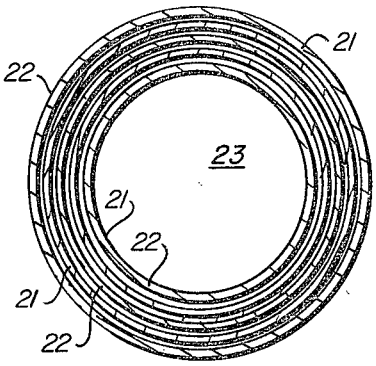
FIG. 9 is a cross-sectional view of one form of the baffle cartridge shown in FIG. 1.
Figure 8:
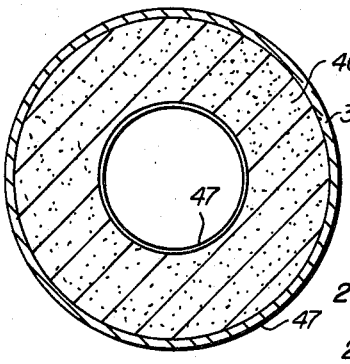
FIG. 8 is a cross-sectional view of FIG. 3 taken along the line 8—8.

As noted from FIG. 3 of the drawings, coupling 39 is provided with internal threads 45 for engaging with an associated air discharging device (not shown). This structure may have external threads, if so desired, as shown in FIG. 1. FIGS. 8, 9 and 20 show cartridge assemblies which can be interchangeably used in silencer assemblies of FIGS. 1, 2 and 3. Cartridge 38 illustrates a one layer cartridge assembly comprising a cylinder of suitable sound absorbent material 46 covered internally and externally along its length by a suitable wire mesh or wire cloth like material 47. Housing 16 is provided with suitable windows 19 for directing air under pressure received by the muffler configuration to atmosphere. This muffler configuration functions in the same general manner as described above for the muffler shown in FIG. 1.

Figure 10:
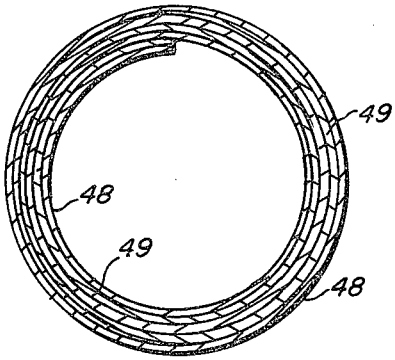
FIG. 10 is a cross-sectional view of another form of the baffle cartridge shown in FIG. 1.

FIGS. 9, 10 and 11 illustrate various cartridge configurations for use in the mufflers shown in FIGS. 1, 2 and 3. In FIG. 9, a coaxial cylindrical arrangement of the elements is shown with a plurality of wire cloth elements 21 shown with cylindrical layers of compressible resilient foam or other suitable sound absorbing material 22 interspersed therebetween as heretofore explained.

In FIGS. 10 and 11, a cartridge configuration is shown comprising a rolled layer of wire mesh or cloth 48 separated with absorbent material 49. The thickness of the cartridge depends on the number of layers of the material used.

As disclosed herein, the silencers and mufflers shown in the drawing generally comprise in combination a hollow cylindrical housing having one or more air chambers, a plurality of standard soft metal washers, a multiple layer composition cartridge easily removable without disconnecting the muffler from the associated equipment all in a novel configuration to provide a low intensity optimum air discharging muffler.

FIG. 4 discloses a modification of the mufflers shown in FIGS. 1–3 wherein muffler 50 comprises a hollow cylindrical housing 51 connected at end 52 thereof to a coupling 53 in a manner similar to the connection of housing 16 of muffler 15 to coupling 17. Housing 51 which also may be connected to the coupling in the same manner as shown in FIG. 2 is provided with a heavy gauge, small mesh disk 54 followed by a plurality of alternate wire mesh disks 54' of similar or different mesh sizes and resilient foam disks 54'' of equal or different thickness which are juxtapositioned in housing 51, as shown, laterally of its longitudinal axis. The disks are arranged in a stack configuration with the thickness variable depending on the number of disks used. The left most disk 54 of the stack at the downstream end thereof may be of a smaller mesh size than the other metallic disks in the stack if so desired to contain the cartridge stack.

The stack of disks are held in place in a partially compressed arrangement by an end plate 55. This end plate comprises a star or cross shape configuration, the legs 56 of which are bent to form trough shaped configurations facing outwardly of the muffler configuration. Pins 57 are inserted in apertures 58 in one or the other of the spaced peripheral arrangements, shown in FIG. 4, to extend one in each of the trough shaped legs 56 of end plate 55 to selectively position and hold the end plate in more than one position along the length of the housing 51.

The axial flow air silencer or muffler shown in FIG. 4 provides means for controlling the degree of compression of the cartridge assembly in order to vary the noise reduction performance characteristics of the silencer.

Figure 5:
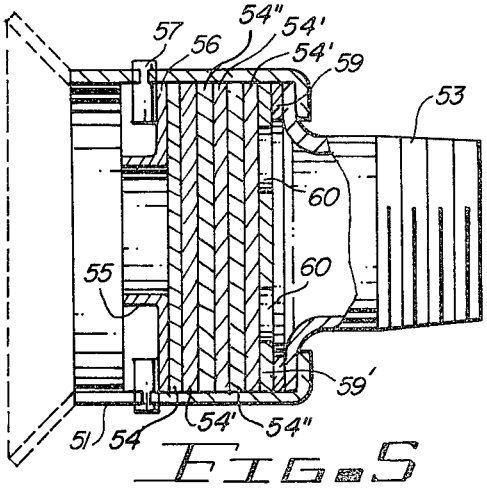
FIG. 5 is a cross-sectional view of FIG. 4 when compressed to its assembled form.

FIG. 5 illustrates the structure shown in FIG. 4 in its compressed form wherein the upstream washer 59 adjacent coupling 53 is soft metal washer. Plate 59' is provided with apertures 60 of different sizes. The perforated plate 59' is intended to break up the blasts or stream of air under pressure received by coupling 53 so as to protect the cartridge stack from premature breakdown. As shown in FIG. 5, pins 57 may be grooved to interlock more effectively with the shell of housing 51, as shown.

FIG. 5 also represents the structure of a muffler for hot gas exhaust applications wherein the disks of the cartridge are made up solely of stacked wire mesh disks of random mesh and wire gauge size without the adjustable feature shown. In this design, the soft metal washer 54 is omitted.

Figure 7:
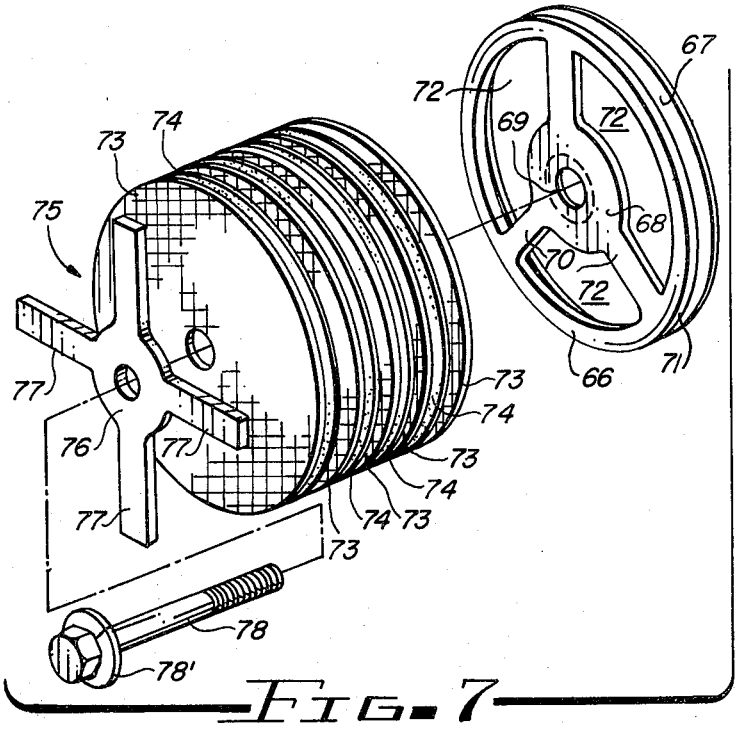
FIG. 7 is an exploded perspective view of the muffler or silencer shown in FIG. 6.
Figure 6:
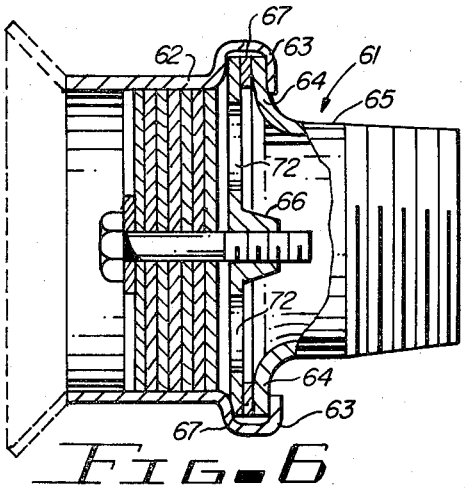
FIG. 6 is a cross-sectional view of a still further modification of the muffler or silencer shown in FIGS. 1, 2 and 4.

FIGS. 6 and 7 disclose a further modification of the muffler shown in FIGS. 4 and 5 wherein the axial flow muffler 61 comprises a housing 62 having a turned in end 63 which captures the flange 64 of the externally threaded coupling 65, gasket 67 and the flange of end plate 66. The end plate is provided with a center collar section 68 having a threaded axial aperture 69 and a plurality of spacedly arranged arms 70 extending outwardly therefrom to a rim 71. The arms 70 define between them flow passageways 72.

The cartridge or sound absorbing portion of the muffler comprises a plurality of disks 73 of like or different mesh or wire cloth material interspaced between disks 74. The disks 74 are formed of suitable sound absorbing material such as compressible foam or textile material.

The retaining plate 75 is provided with an apertured center portion 76 having a plurality of arms 77 extending radially outwardly therefrom. A bolt 78 extends through plate 75 and apertures in the centers of disk 73 and 74 and threadedly engages plate 66. The center portion 76 supports the head of bolt 78 and washer 78' so that upon tightening up on the pressure on disks 73 and 74 or backing off thereon, an infinite step adjustment of the cartridge compression may be obtained which in turn controls the muffling and discharge rate of the muffler and its silencing effect.

The cartridge is the main absorbing element in the muffler. It is made up of alternate layers of wire cloth material and a suitable grade of compressible foam or textile material. In FIGS. 1–3, the air passes radially through the cartridge wall thus crossing alternate layers of wire cloth and resilient foam (or alternate material) and discharges into the atmosphere through large windows or ports in the shell or housing. In the configuration shown in FIG. 10, the wire cloth and resilient foam material are rolled or wound concentrically forming alternate layers of wire cloth and resilient material to absorb different noise frequencies. The inner and outer surfaces of the cartridges in FIGS. 8, 9 and 10 are made up of one or more layers of wire cloth or wire mesh. The inner layers prevent loading of the cartridge with foreign particles and absorb the initial shock of the air discharge. The outer layers are primarily for strength and air diffusion.

Each layer of the cartridge is made up of a resilient compressible material sandwiched between two wire cloth cylinders. Air flowing through the sandwich is subjected to alternate contraction, expansion and contraction again due to the varying restriction through the materials making up the sandwich.

The contraction and expansion process through each sandwich absorbs a portion of the energy stored in the air as it flows through the cartridge. This process is repeated several times, the number of times depending on the density of the resilient material, its thickness and the wire cloth mesh used. Thus, it is possible to obtain any degree of quietness for a range of air discharge rates. The resiliency of the material adds another very important factor to the quietness of the silencer. The velocity of the air being discharged from the device drops exponentially at the instant air discharge starts. Air flows initially at a high velocity, the rate of which is regulated by the washer before it enters the outer or diffusion chamber. This velocity head is changed to a large extent into a pressure head which compresses the resilient layers thus causing a momentary high resistance to the air flow. As the air flow drops abruptly, it is accompanied by a decompression of the resilient layers thus maintaining a higher average rate of discharge through the cartridge as compared to an incompressible medium which has a constant flow characteristic. The wire cloth layers, in addition to generating the contraction and expansion effect, help contain the resilient layers to limit their magnitude of motion to prevent excessive flexing and consequent breakdown of the compressible material. The resilient layers are precompressed, the extent of precompression depending on the noise muffling desired. The compressible nature of the material and the resulting motion within the layers, due to the varying rates of air flow, help dislodge foreign particles thus preventing premature loading of the compressible layers. This breathing action performs a dual function; first, it provides an automatic means for varying the resistance to the air flow; secondly, it helps prevent premature loading of the cartridge. Each layer can be designed to provide an equal or varying value of energy absorption. The number of layers and the materials in each layer in a cartridge is determined by the noise criteria established by governmental agencies, and upon the standard established by industry for maximum allowable discharge time for a given load.

A well designed silencer meets both of these requirements. The disclosed silencer or muffler not only meets but exceeds all such requirements; it is compact for applications where space is limited and it is mechanically strong to prevent damage.

The shell is made of tubular material and is designed to withstand impacts from external sources and extreme vibrations inherent to some equipment it may be mounted on. It is provided with large apertures or windows through which the air is exhausted to the atmosphere. The shell is not used to regulate air flow to the atmosphere as in the case in some existing silencers. These apertures can also be located on one side of the shell to obtain directional discharge required by some installations to prevent personnel exposure to air blasts, to avoid contamination of operating equipment and to promote good plant housekeeping by directing the air discharge, which may contain lubricating oils, away from building internal structures.

In FIGS. 4 and 5, the muffler employs means for adjusting the compression of the cartridge stack in three steps. In FIGS. 6 and 7 the muffler employs a gradual means for adjusting the compression of the cartridge stack. The cartridge stack shown in FIG. 5 represents the condition of highest noise attenuation with an acceptable air discharge rate. As the stack compression is reduced, the noise attenuation is decreased and the air discharge rate is increased.

When a silencer has been in operation for a length of time, foreign particles will have been deposited in the cartridge layers thereby reducing the air discharge rate and the noise level, but increasing air back pressure build up in the silencer. To correct this condition the compression of the stack is reduced thus restoring the original performance characteristics of the silencer without removing it from the line for repairs or replacement for long periods of time.

It should be noted that the structures shown in the drawings may be used for hot gas discharge devices such as internal combustion engines by merely removing the resilient porous material from the cartridges and merely employing cylinders, layers or disks or like or different mesh sizes.

Although but a few embodiments of the present invention have been illustrated and described, it will be apparent to those skilled in the art that various changes and modifications may be made therein without departing from the spirit of the invention or from the scope of the appended claims.

What is claimed is:

1. An air exhaust silencer comprising:

a housing having an air inlet means at one end of said housing for attachment to an air exhaust and at least one exhaust port, and a detachably mounted cartridge axially arranged within said housing, said cartridge comprising a plurality of contiguous layers of wire mesh and resilient porous material arranged sequentially in the path of movement of all of the air flow under pressure through the silencer, said layers of resilient porous material confined between adjacent layers of wire mesh deflect under pressure surges of the air passing therethrough to substantially prevent premature loading of the porous material and excessive flexing and disintegration thereof.

2. The air exhaust silencer set forth in claim 1 wherein:

said layers of resilient porous material are partially compressed laterally of the longitudinal axis of said cartridge between the adjacent layers of said wire mesh.

3. The air exhaust silencer set forth in claim 1 wherein:

each of said layers of resilient porous material is confined between two of said layers of wire mesh having different mesh sizes resulting in different flow characteristics of said cartridge causing different expansion and contraction effects of the confined resilient porous material for effectively absorbing the energy in the air exhaust, said layers of wire mesh and resilient porous material being capable of absorbing air exhaust noise of different frequencies.

4. The air exhaust silencer set forth in claim 1 in further combination with:

a relatively soft metal washer having an orifice mounted between said coupling and said cartridge and held under pressure thereby for controlling noise amplification of said housing.

5. The air exhaust silencer set forth in claim 4 in further combination with:

a relatively hard apertured metal washer interposed between said cartridge and said soft metal washer to attenuate initial high turbulence and air surges of the air exhaust.

6. The air exhaust silencer set forth in claim 1 in further combination with:

a rubber gasket mounted adjacent the downstream end of said cartridge, and a soft metal plate mounted downstream of said gasket to minimize noise amplification by said housing.

7. The air exhaust silencer set forth in claim 6 in further combination with:

a metal plate mounted downstream of said soft metal plate to prevent extrusion of said rubber gasket out of said housing.

8. The air exhaust silencer set forth in claim 1 wherein:

said housing comprises a cylindrical configuration, said cartridge comprises a plurality of coaxially arranged cylindrical elements forming a hollow core configuration, and wherein air exhaust entering the silencer extends along the full length of said core before moving through said layers of wire mesh and resilient porous material.

9. The air exhaust silencer set forth in claim 1 wherein:

said housing comprises a cylindrical configuration, and said cartridge comprises a roll of layered material comprising alternate layers of wire mesh and resilient foam like material.

10. The air exhaust silencer set forth in claim 1 wherein:

said layers comprise a plurality of disks arranged along the length of said housing with their plane surfaces extending laterally of the longitudinal axis of said housing.

11. The air exhaust silencer set forth in claim 10 wherein:

said disks are arranged substantially perpendicular to the longitudinal axis of said housing.

12. The air exhaust silencer set forth in claim 10 in further combination with:

means for adjustably compressing the disks of said cartridge to vary the resistance to the air flow through said cartridge.

13. The air exhaust silencer set forth in claim 1 wherein:

said exhaust port comprises a plurality of windows extending along the length of said housing.

14. The air exhaust silencer set forth in claim 1 wherein:

said air inlet means comprises a coupling having a thickness substantially greater than the thickness of said housing for absorbing the vibrations of the air exhaust, said coupling comprises a flange extending outwardling and around its periphery, said housing is detachably connected to said flange, and said cartridge is maintained in said housing by an end plate detachably secured to the other end of said housing.

15. The air exhaust silencer set forth in claim 14 wherein:

said end plate is detachably securable to more than one position along the end of said housing.

16. A fluid exhaust silencer comprising:

a housing having an air inlet means at one end of said housing for attachment to fluid exhaust and at least one exhaust port, and a detachably mounted cartridge axially arranged within said housing, said cartridge comprising a plurality of contiguous layers of wire mesh arranged sequentially in the path of movement of the fluid flow under pressure through the silencer, said layers of wire mesh comprising a selection of different wire mesh sizes.

17. The fluid exhaust silencer set forth in claim 16 wherein:

the layers of wire mesh comprise a selection of different wire mesh sizes.

18. The fluid exhaust silencer set forth in claim 17 wherein:

the layers of wire mesh comprise a plurality of disks of uniform diameter.

19. The air exhaust silencer set forth in claim 1 wherein:

said layers of resilient porous material are partially compressed longitudinally of said cartridge between the adjacent layers of said wire mesh.

20. The air exhaust silencer set forth in claim 9 wherein:

the inner wall of said cartridge comprises one end of said material with said material continuing uninterrupted through the intermittent layers forming said cartridge until it forms the outside peripheral surface of said cartridge, whereby said cartridge can be unrolled, washed and rerolled for further use in the silencer.

21. The air exhaust silencer set forth in claim 1 wherein:

said layers of resilient porous material confined between adjacent layers of said wire mesh are compressed by the initial air wave front to attenuate peak impact noise occuring at the moment of highest pressure and air discharge.

22. The fluid exhaust silencer set forth in claim 16 wherein:

said layers of wire mesh comprise a selection of different wire mesh sizes arranged in a random configuration.

23. The air exhaust silencer set forth in claim 2 wherein:

said layers of resilient porous material when compressed laterally of the longitudinal axis of said cartridge between adjacent layers of wire mesh expand outwardly to form a snug fit between said cartridge and the inside surface of said housing.

* * * * *